US005268540A

United States Patent [19]

Rex

[11] Patent Number: 5,268,540

[45] Date of Patent: Dec. 7, 1993

[54] SOUND BARRIER ABSORPTION PANEL

[75] Inventor: Robert G. Rex, Villanova, Pa.

[73] Assignee: Superior Precast, Inc., Pottstown, Pa.

[21] Appl. No.: 781,973

[22] Filed: Oct. 24, 1991

[51] Int. Cl.[5] ..... G10K 11/00; E04H 17/00

[52] U.S. Cl. ..... 181/210; 181/284; 181/290

[58] Field of Search ..... 181/284, 287, 290, 291, 181/294, 210; 52/144, 145, 282; 405/275, 284, 285, 286; 256/19, 24

[56] References Cited

U.S. PATENT DOCUMENTS

| | | | |
|---|---|---|---|
| 1,928,034 | 9/1930 | Schulstadt | 181/290 |
| 4,094,380 | 6/1978 | Kobayashi et al. | 181/285 |
| 4,143,495 | 3/1979 | Hintz | 181/290 |
| 4,241,806 | 12/1980 | Metzger | 181/284 |
| 4,425,981 | 1/1984 | Kiesewetter et al. | 181/286 |
| 4,555,433 | 11/1985 | Jablonka et al. | 181/284 |
| 4,566,558 | 1/1986 | Link, Jr. et al. | 181/210 |
| 4,706,422 | 11/1987 | Ashton | 181/284 |
| 4,989,688 | 2/1991 | Nelson | 181/287 |
| 5,031,721 | 7/1991 | Barden et al. | 181/210 |

*Primary Examiner*—Michael L. Gellner
*Assistant Examiner*—Eddie C. Lee
*Attorney, Agent, or Firm*—Wall and Roehrig

[57] ABSTRACT

A sound absorbing noise barrier panel has a precast reinforced concrete skin with a series of integral horizontal reinforcing ribs that provide a structurally strong panel that will resist wind loading and other requirements. The ribs form compartments on one surface of the panel skin which are filled with a sound absorbing material. A metal screen protective mesh is used to cover the compartments containing the sound absorbing material A decorative fabric is placed over the mesh and a protective decorative glass reinforced concrete lattice is used to finish the panel, resulting in a noise reduction coefficient of 0.95 to 1.0.

3 Claims, 2 Drawing Sheets

SOUND BARRIER ABSORPTION PANEL

BACKGROUND OF THE INVENTION

This invention relates to sound barriers, and more particularly to an improved sound absorption panel adapted to be used in association with other similar panels in a barrier for reflecting and absorbing sound.

Sound barriers of this type are particularly adapted for use in controlling noise generated by road traffic, but it will be apparent from the following description that the invention could be employed in other situations such as industrial applications to shield noisy machines, sound barriers at airports and similar applications.

The unwanted sound from vehicles, airplanes, and machinery is commonly referred to as noise. In urban areas noise from transportation sources has been a perennial problem, and typical solutions have included wall-like structures placed along the perimeter of the noise source to separate the noise source from adjacent residential or other living areas. For a number of years now the principle attempt at reducing noise has been to reflect the noise back into the generating source or up into the atmosphere, but as the congestion of space has become greater, this approach has merely redirected the noise to a different area without abating it. The most recent attempts at abating transportation noise have included noise absorption devices for absorbing and reducing the transmission of noise from the noise generator to surrounding adjacent areas.

Most noise absorbing panels known to applicant have heretofore been made of relatively soft, porous and fibrous materials in order to absorb the sound which has resulted in panels of limited durability, particularly when installed in adverse environmental locations and under conditions where the panels are expected to endure for extended periods of time.

OBJECTS AND SUMMARY OF THE INVENTION

Accordingly, it is an object of the present invention to provide a sound absorption panel for use in sound barriers around noise sources that overcomes the limitations of the prior art.

It is another object of the present invention to provide a sound absorption barrier that is durable under all types of adverse weather and environmental conditions.

It is another object of the present invention to provide a structurally strong and rugged noise absorption barrier that will withstand physical and weather conditions encountered alongside heavily travelled highways.

It is another object of the present invention to provide a sound barrier/absorption panel construction permitting use of panels of extended length requiring less frequent post supports for use as a sound absorbing barrier along highways and around other noise sources.

It is another object of the present invention to provide a precast concrete noise barrier panel with sound absorption capabilities in an attractive and pleasing configuration for use in upscale business and residential areas to separate heavily trafficked highways from such residential and business areas.

These and further objects are attained in one embodiment in which a reinforced precast concrete panel skin is formed with structural ribs extending therefrom at spaced intervals to provide structural strength to the panel and to form compartments throughout the panel.

The compartments are filled with a sound absorbing material and covered with a protective metal mesh which is in turn covered with a decorative material which allows penetration of noise and a second outer cover of a fiberglass reinforced concrete lattice that adds a decorative effect along with structural protection to provide a finished surface of the open side of the panel comparable to the skin side. The finished panel can be easily and quickly erected by supporting it in spaced apart structural posts secured to poured concrete footings in the ground at the appropriate intervals. A rugged yet decorative noise absorption barrier is thus obtained.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF A PREFERRED EMBODIMENT

Figure 1:
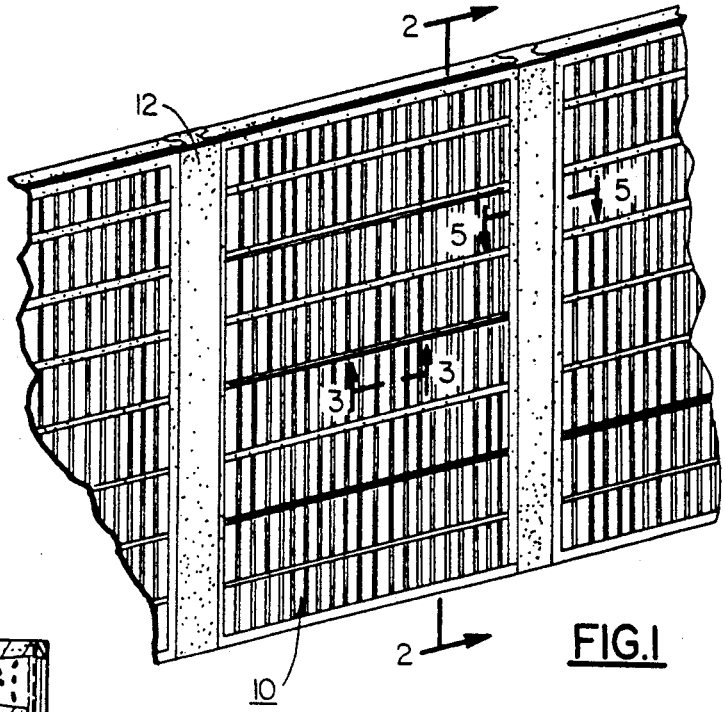
FIG. 1 is a perspective view of a panel in accordance with the present invention, mounted in a pair of posts for holding the panel in the desired vertical orientation.
Figure 2:
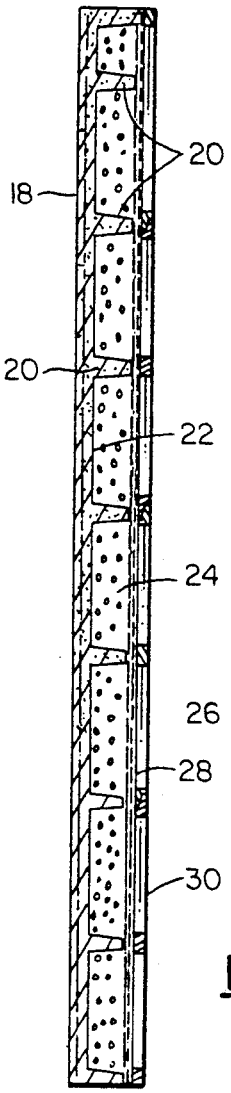
FIG. 2 is a cross-sectional view of the panel taken on line 2—2 of the panel of FIG. 1.

Referring now to FIG. 1 a panel 10 according to the present invention is shown installed between a pair of posts 12 by positioning the edge tongues 14 of the panel 10 in the grooves 16 in the posts 12. The posts 12 may be those shown in my co-pending patent application Ser. No. 07/747,722 filed Aug. 19, 1991, which are formed of precast reinforced concrete to meet the expected environmental load conditions imposed by wind and other site conditions. As shown in FIG. 2, the panel 10 includes a skin 18 which extends throughout one surface thereof, along with a series of integral ribs 20, all of which are formed of precast reinforced concrete, as is well known in the art. The skin 18 and the ribs 20 are dimensioned and reinforced to provide the necessary structural strength for the particular application of the panel at the site, taking into account things such as wind loading, weather, traffic impact, and other factors.

The series of ribs 20, which are spaced nominally at two foot intervals from the bottom to the top of the panel 10 form a series of compartments 22 or recesses in the one face of the panel. These recesses are shown in FIGS. 1 and 2 as horizontal, but they could be vertical or a combination. To absorb noise impinging on this side of the panel, these recesses or compartments 22 are filled with a sound absorbing material 24. This material may advantageously be a particulate mineral material such as that sold under the trademark "Zonolite" by W. R. Grace Co. Other sound absorbing material such as fiberglass bats may be used to fill the compartments 22, as desired. Different materials may be more advantageous for certain types of noise than others and the specific sound absorbing material is chosen to optimize the sound absorption for the specific panel application.

Figure 4:
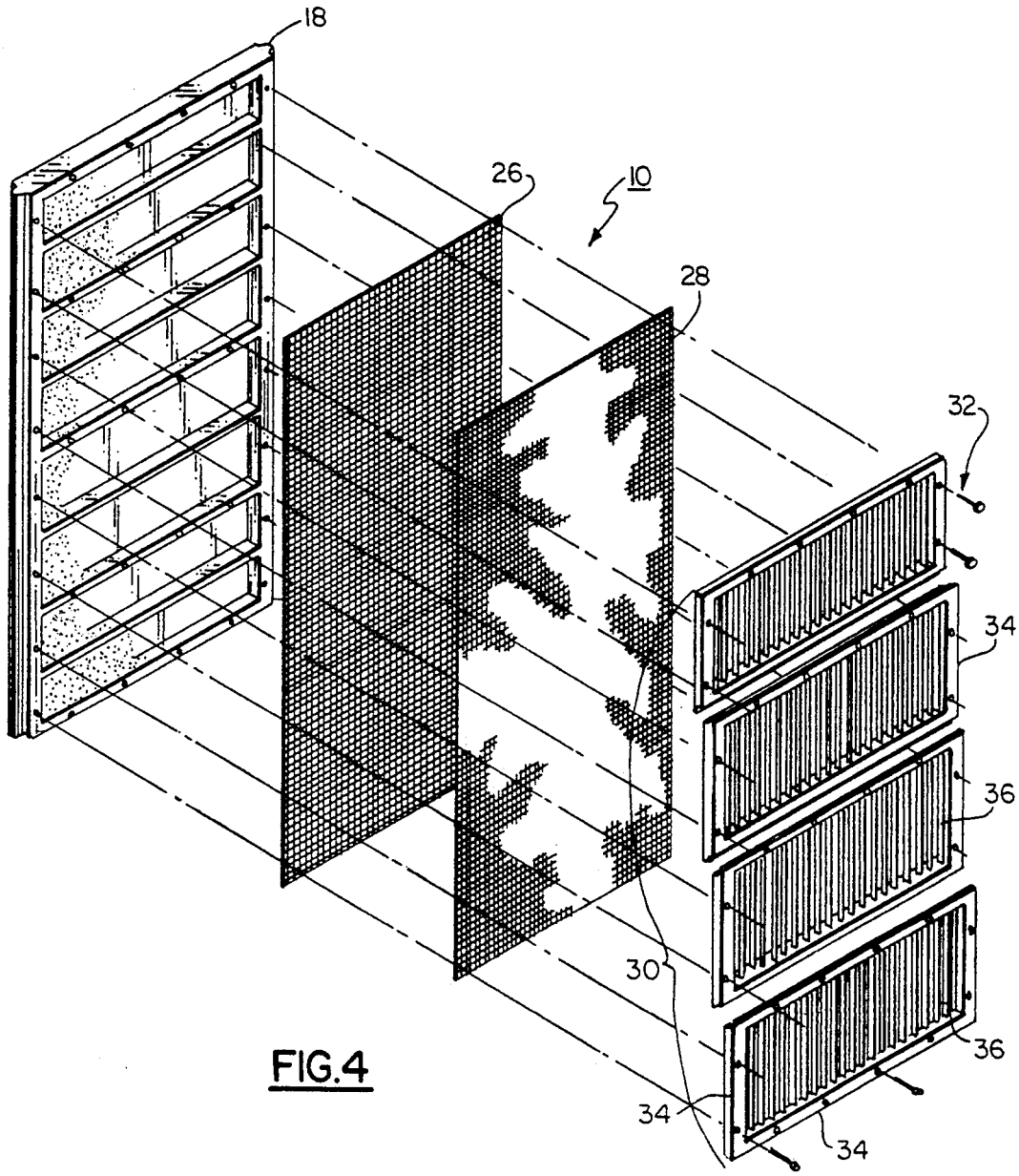
FIG. 4 is an exploded view of the panel of FIG. 1 with the layers separated to show the construction and the different materials used for each portion.

The material 24 may be mixed with an adhesive or other binder that will hold the material in place when applied to the panel to fill the compartments 22. The compartments 22 may be filled with the panel laid in the horizontal position and a protective screen 26 fixed to the panel to protect the sound absorbing material, and secure the insulation in place. When the panel is installed in the vertical position, the material cannot fall out of the compartments 22 and is protected from physical and environmental damage. As can be seen in FIG. 4, the screen mesh 26 is preferably a metal mesh having a gauge small enough to keep the sound absorbing material in place and prevent its falling out through the mesh, but at the same time allowing easy penetration of the noise into the sound material for absorption therein. The screen 26 generally extends from top to bottom and side to side of panel 10. If the wire of the mesh becomes too great a percentage of the area under consideration, a significant portion of the sound may be reflected rather than being absorbed in the material 24.

Referring again to FIG. 1 and 4, after the screen mesh 26 is positioned over top of the compartments 22 to hold and protect the material 24, a decorative fabric 28 can be applied to improve the appearance of the open surface of the panel 10. This can take the form of a sound transmitting and absorbing vinyl material with sufficient porosity so that the sound can penetrate this barrier and be absorbed by the material 24 rather than being reflected back into the environment. A particular fabric that has been found to be advantageous is a knitted vinyl sold under the trademark "COMFORT-WEAVE" By Product Sales Assoc., Inc., W. Hempstead, N.Y.

Figure 3:
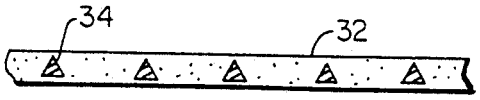
FIG. 3 is a partial sectional view taken on line 3—3 of FIG. 1.

Finally, as a final covering to physically protect both the decorative material 28 and the screen 26 as well as the sound absorbing material 24 in the compartments from the normal environmental hazards along a major highway, there is provided a glass reinforced concrete cover 30. Cover 30 is advantageously made in a series of panels 32 that are dimensioned in multiples of the compartment 20 dimensions for mounting on the open face of the reinforced concrete panel 10. Each panel 32 is basically a frame 34 of glass reinforced concrete that extends from side to side and rib to rib of the panel. Panels 32 are adapted to be secured to the edges and ribs 20 of the panel 10 with fasteners (not shown) and form a lattice in contact with the material 28 on top of the open side of panel 10. The lattice is shown in cross-section in FIG. 3. The vertical lattice ribs 36 have a generally triangular cross-section which form with the panel a decorative surface for the open side of the panel 10. The panels 32 could, of course, be part of an overall one-piece cover 30 instead of separate modules. Vertical ribs 36 extend from top to bottom of the frame 34 of each panel and are aligned panel to panel to give the vertical look of FIG. 1. Panels 32 are precast glass reinforced concrete.

The skin side 18 of the panel can be smooth or can have suitable decorative ridges formed in it, as may be required to meet the aesthetic requirements of the area in which the panels are to be installed.

Figure 5:
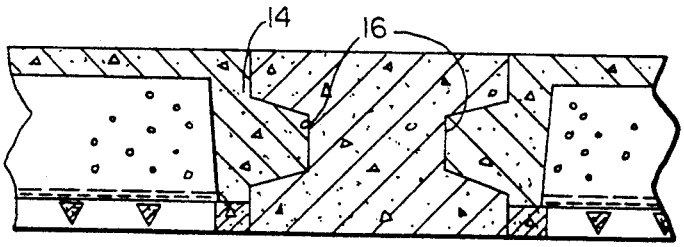
FIG. 5 is a cross-sectional view taken on line 5—5 of FIG. 1.

Upon installation, the panels 10 are positioned as shown in FIGS. 1 and 5 and they are usually positioned with the sound absorbing open side facing the source of the noise. The noise will impinge on the open surface of the panel 10, go through the lattice of cover 30, the fabric 28 and screen 26, to be absorbed in the sound absorbing material 24. The skin section 18 is preferably made of a concrete material that does not readily transmit sound. The sound from the roadway is substantially absorbed by the panel and very little is transmitted on through.

In the noise reduction industry, the effectiveness of a noise absorption panel has been defined by a Noise Reduction Coefficient which indicates the efficiency of the panel in absorbing noise incident thereon. With the construction described above, applicant has been able to achieve Noise Reduction Coefficients from 0.95 to 1.0. Minimum requirements for most highway applications are that the Noise Reduction Coefficient must be at least 0.80 and typical panels currently available on the market have a Noise Reduction Coefficient of approximately 0.85.

It can thus be seen that I have provided not only a highly efficient noise barrier absorption panel, but I have provided one that is structurally easy to fabricate, is strong and will stand up to the environmental weather and traffic environments in which it is normally used. The panel not only will stand up to the usual environment and weather, but it will also resist the common vandalism encountered in installations of this type.

While this invention has been explained with reference to the structure disclosed herein, it is not confined to the details set forth and this application is intended to cover any modifications and changes as may come within the scope of the following claims.

What is claimed is:

1. A noise barrier panel for reducing noise transmission and reflection which comprises:

a rectilinear panel having a generally planar first surface and a compartmented second surface;

said compartmented second surface having a plurality of open recesses and a plurality of structural ribs integrally formed with said first planar surface to form said open recesses and to stiffen said panel;

a quantity of sound absorbing material disposed in said open recesses;

a protective mesh positioned across said compartmented surface to protect said sound absorbing material;

a decorative outer lattice cover fixed to said rectilinear panel over top of said protective mesh; and a layer of decorative fabric interposed between said protective mesh and said decorative outer cover.

2. An exterior noise barrier panel for reducing transmission of noise from a source to adjacent areas comprising in combination:

a precast reinforced concrete wall unit having a generally smooth surface on one side and a plurality of integral structural ribs formed on an opposite side, said unit having a top wall, bottom wall, and two side walls that form an open box;

said ribs forming a plurality of compartments within said box;

a quantity of sound absorbing material positioned with said compartments;

a screen covering said compartments and being in contact with said ribs to retain said sound absorbing material within said compartments;

a rigid outer panel fabricated of glassed reinforced concrete and having sufficient strength to withstand severe environmental wind-loading conditions, said panel further having a plurality of openings therein mounted over said screen disposed in front of said wall unit and securely fastened thereto in face-to-face contact with said screen to secure said screen and said sound absorbing material therebetween so that noise incident on said opposite side will be absorbed by said sound absorbing material in said compartments; and a layer of decorative fabric interposed between said screen member and said outer panel, said fabric having a plurality of openings therein to allow penetration of noise into said sound absorbing material and to provide an aesthetic appearance for the compartmented side of said wall unit.

3. A noise barrier panel for reducing transmission of noise from a source to adjacent areas comprising in combination;

a precast reinforced concrete wall unit having a generally smooth surface on one side and a plurality of integral structural ribs formed on an opposite side;

said ribs forming a plurality of compartments throughout said opposite side;

a quantity of ground up automobile tires positioned in said compartments;

a screen member including a metal grid having apertures small enough to physically retain said sound absorbing material in said compartments;

an outer cover comprising a glass fiber reinforced concrete lattice of horizontal and vertical strips forming a plurality of openings therebetween, said cover being mounted over said screen so that noise incident on said opposite side will be absorbed by said sound absorbing material in said compartments.

* * * * *